US006276981B1

(12) United States Patent
Perrin et al.

(10) Patent No.: US 6,276,981 B1
(45) Date of Patent: Aug. 21, 2001

(54) METHOD FOR OBTAINING SELF-ALIGNED OPENINGS, IN PARTICULAR FOR MICROTIP FLAT DISPLAY FOCUSING ELECTRODE

(75) Inventors: Aimé Perrin, Saint Ismier; Brigitte Montmayeul, Bernin; Régis Blanc, Saint Egreve, all of (FR)

(73) Assignee: Commissariat a l'Energie Atomique (FR)

( * ) Notice: Subject to any disclaimer, the term of this patent is extended or adjusted under 35 U.S.C. 154(b) by 0 days.

(21) Appl. No.: 09/463,444

(22) PCT Filed: May 25, 1999

(86) PCT No.: PCT/FR99/01219

§ 371 Date: Apr. 4, 2000

§ 102(e) Date: Apr. 4, 2000

(87) PCT Pub. No.: WO99/62094

PCT Pub. Date: Dec. 2, 1999

(30) Foreign Application Priority Data

May 26, 1998 (FR) ..... 98 06608

(51) Int. Cl.[7] ..... H01J 9/02
(52) U.S. Cl. ..... 445/24
(58) Field of Search ..... 445/24; 438/20

(56) References Cited

U.S. PATENT DOCUMENTS

| | | | | |
|---|---|---|---|---|
| 4,857,161 | | 8/1989 | Borel et al. | 204/192.26 |
| 4,940,916 | | 7/1990 | Borel et al. | 313/306 |
| 5,981,304 | * | 11/1999 | Perrin et al. | 438/20 |
| 6,045,426 | * | 4/2000 | Wang et al. | 445/25 |

FOREIGN PATENT DOCUMENTS

| | | | |
|---|---|---|---|
| 0834897 | 4/1998 | (EP) | H01J/9/02 |
| 7029484 | 1/1995 | (JP) | H01J/1/30 |
| 7085779 | 3/1995 | (JP) | H01J/9/02 |
| 9747021 | 12/1997 | (WO) | H01J/9/02 |

* cited by examiner

*Primary Examiner*—Kenneth J. Ramsey
(74) *Attorney, Agent, or Firm*—Hayes, Soloway, Hennessey, Grossman & Hage, PC

(57) ABSTRACT

The invention involves the making of a group of apertures spaced in a precise manner on a structure and including, for example, a first aperture made in a first layer and a second aperture made in a second layer which covers the first layer, the first aperture being located within the second aperture. This involves:

applying a first layer (41) of photosensitive resin, the etching of this resin layer by photolithography, by means of a single template, to leave a spot of resin (42) per group of apertures on the first layer (41), the exterior limits of the resin spot corresponding to the second aperture, and with the resin spot including an aperture (43) corresponding to the first aperture, vacuum application on the first layer (41) and on the remaining resin of material (44) which will make up the second layer, this application being done so that the part (45) of the first layer located at the bottom of the aperture (43) of the resin spot (42) is not covered by this deposit, the etching of the first layer (41) from the aperture (43) of the spot (42) to obtain the first aperture (46) in the first layer, elimination of the remaining resin and material covering it to obtain the second aperture in the second layer.

7 Claims, 6 Drawing Sheets

METHOD FOR OBTAINING SELF-ALIGNED OPENINGS, IN PARTICULAR FOR MICROTIP FLAT DISPLAY FOCUSING ELECTRODE

FIELD OF THE INVENTION

This invention involves a process for making at least one group of apertures spaced in a precise manner on a structure by photolithography, this group of apertures including a first aperture or apertures made in a first layer of material and a second aperture made in a second layer of material which covers the first layer of material, the first aperture or apertures being located within the second aperture. It involves in particular the making of a auto-aligned focusing grid for a flat micropoint screen.

STATE OF THE ART

Documents FR-A-2 593 953 and FR-A-2 623 013 disclose devices for visualisation by cathodoluminescence excited by field emission. These devices include a micropoint emitting cathode electron source.

By way of illustration, FIG. 1 is a cross section view of such a micropoint viewing screen. The screen is composed of a cathode 1, which is a plane structure, oriented with respect to another plane structure which forms the anode 2. The cathode 1 and the anode 2 are separated by a space in which a vacuum has been created. The cathode 1 includes a glass substrate 11 on which the conductor level 12 has been applied in contact with the electron emitting points 13. The conductor level 12 is covered with a layer of insulation 14, made of silica for example, which is itself covered by a conducting layer 15. Holes 18 of about 1.3 $\mu$m in diameter were made through the layers 14 and 15 up to the conducting level 12 to apply the points 13 on this conductor level. The conducting level 15 acts as an extraction grid for the electrons which will be emitted by the points 13. The anode 2. includes a transparent substrate 21 covered by a transparent electrode 22 on which luminescent phosphors or luminophores 23 have been deposited.

The operation of this screen will now be described. The anode 2 is brought to a positive voltage of several hundred volts with respect to the points 13 (typically 200 to 500 V). A positive voltage of several dozens of volts (typically 60 to 100 V) with respect to the points 13 is applied to the extraction grid 15. Electrons are then drawn from the points 13 and are attracted by the anode 2. The trajectories of the electrons are within a half-angle cone at the peak $\Theta$, depending on various factors such as the shape of the points 13. This angle causes a defocusing of the electron beam 31 which increases as the distance between the anode and the cathode is increased. One way to increase the yield of the phosphors, and thus the luminosity of the screens, is to work with higher anode-cathode voltages (between 1,000 and 10,000 V), which implies separating the anode and the cathode further in order to avoid the formation of an electric arc between these two electrodes.

If good resolution on the anode is desired, the electron beam must be refocused. This refocusing is classically obtained with a grid which can either be placed between the anode and the cathode or placed on the cathode.

FIG. 2 illustrates the case where the focusing grid is placed on the cathode. FIG. 2 repeats the example of FIG. 1, but limited to a single micropoint for greater clarity in the drawing. An insulating layer 16 was applied to the extraction grid 15 and bears a metallic layer 17 which acts as a focusing grid. Holes 19 of an appropriate diameter (typically between 8 and 10 ·m) and concentric to holes 18, were etched in layers 16 and 17. The insulating layer 16 electrically insulates the extraction grid 15 and the focusing grid 17. The focusing grid is polarised with respect to the cathode in order to give the electron beam the shape shown in FIG. 2.

Simulation calculations show that centering of the holes 19 of the focusing grid with respect to the holes 18 of the extraction grid is extremely important. This structure is generally made using the classic photoetching techniques used in microelectronics. For example, with a first level of photoetching, the holes 19 of the focusing grid are defined, then a second level of photoetching is used to make holes 18 in which the points will be placed. To ensure proper functioning, the second level must be positioned in an extremely precise manner with respect to the first level. This can only be done with very high-quality, expensive equipment, a serious drawback if large areas are treated.

SUMMARY OF THE INVENTION

The invention solves the problem of precision alignment of holes located on different levels. This is achieved by a process which requires only a single photolithography step and only one template for two types of patterns: those for the holes on the lower level of lesser diameter and those for the upper level holes of greater diameter. The precision of the relative positioning of the holes is therefore that of the template pattern.

The purpose of the invention is thus the making by photolithography of at least one group of apertures spaced in a precise manner on a structure, this group of apertures including a first aperture or apertures made in a first layer of material and a second aperture made in a second layer of material which covers the first layer of material, the first aperture or apertures being located within the second aperture, characterised in that it includes:

- the depositing on the free side of the first layer of material of a photosensitive resin layer of a determined thickness,
- the etching of this resin layer by photolithography, by means of a single template, to leave on the aforesaid first layer of the material one spot of resin per group of apertures, the exterior limit of the spot of resin corresponding to the second aperture, the spot of resin including an aperture or apertures corresponding to the first aperture or apertures,
- vacuum application, on the first layer and on the remaining resin, of material to form the second layer, this deposit being done so that the part of the first layer located at the bottom of the aperture or apertures of the spot of resin is not covered by this deposit,
- the etching of the first layer of material from the aperture or apertures of the spot to obtain the first aperture or apertures in the aforesaid first layer,
- elimination of the remaining resin and material from the second layer covering the aforesaid remaining resin to obtain the second aperture in the aforesaid second layer.

The aforesaid group of apertures can include a first aperture which is a circular hole centred in the second aperture which is also a circular hole. It may also include first apertures which are circular holes oriented along the main axis of the second aperture which is a slit.

This process is advantageously applied to manufacturing of a micropoint electron source with an extraction grid and a focusing grid. According to the invention, a manufacturing process for such a source involves:

a step during which are successively applied to one side of an electrically-insulated support: means for cathodic connection, a first layer of electrical insulation of a thickness adapted to the height of the future micropoints, a first conducting layer to form the extraction grid, a second electrically insulating layer of thickness corresponding to the distance which must separate the extraction grid from the focussing grid, and a layer of photosensitive resin of a given thickness, a step for etching the resin layer by photolithography, by means of a single template, to leave on the aforesaid second insulating layer one spot of resin per aperture of the focussing grid, the exterior limit of the aforesaid spot of resin corresponding to the aforesaid aperture of the focussing grid, the spot of resin including one aperture per aperture of the extraction grid contained in the aforesaid aperture of the focussing grid, a step for vacuum application on the second insulating layer and on the remaining resin of a material to form the focussing grid, this deposit being made so that the part of the second insulating layer located at the bottom of each aperture of the spot of resin is not covered by this deposit, a step during which the second insulating layer and the first conducting layer are successively etched from the part of the second insulating layer not covered by the aforesaid deposit to obtain holes in the second insulating layer and the apertures of the extraction grid, a step for etching of the first insulating layer through the apertures of the extraction grid up to the means of cathodic connection, a step of lateral etching of the second insulating layer to increase the size of the holes etched previously to a given value, this lateral etching possibly intersecting adjacent holes which are sufficiently close, a step involving elimination of the remaining resin and the part of the material to make the focussing grid which covers the remaining resin, a step for making micropoints on the means of cathodic connection through the apertures in the extraction grid.

The means for cathodic connection can be obtained by depositing cathodic conductors on the support, followed by depositing of a resistant layer.

Advantageously, the step for etching the first insulating layer and the step for lateral etching of the second insulating layer are carried out simultaneously and done by isotropic etching.

The remaining resin can be eliminated using the lift-off technique.

BRIEF DESCRIPTION OF DRAWINGS

The invention will be better understood and its. other advantages and characteristics will be clearer with a reading of the following description, which is given as a non-limiting example, accompanied by drawings in appendix among which.

DETAILED DESCRIPTION OF AN EMBODIMENT OF THE INVENTION

Figure 1:
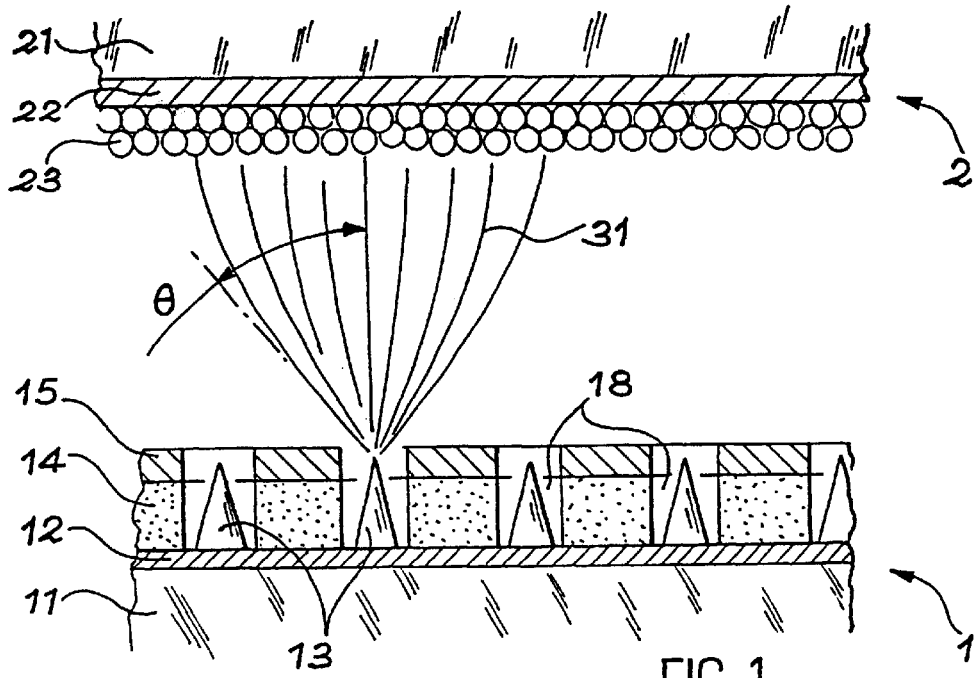
FIG. 1, already described, illustrates a flat micropoint screen based on the prior art, FIG. 2, already described, illustrates a flat micropoint screen with a focussing grid based on the prior art.
Figure 2:
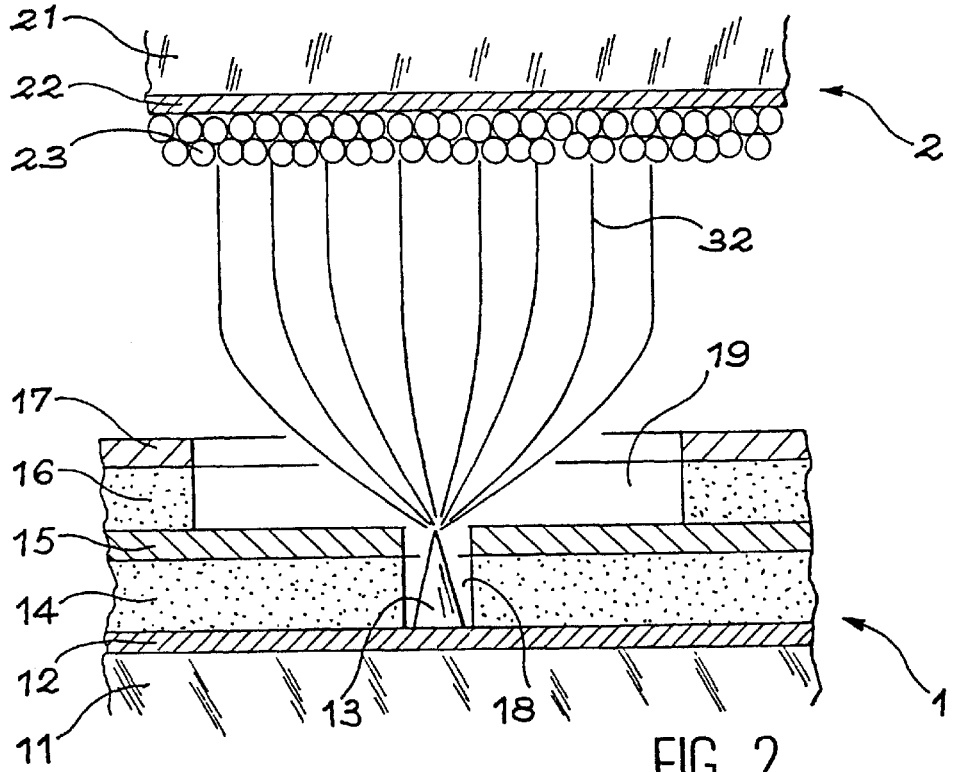
Figure 3:
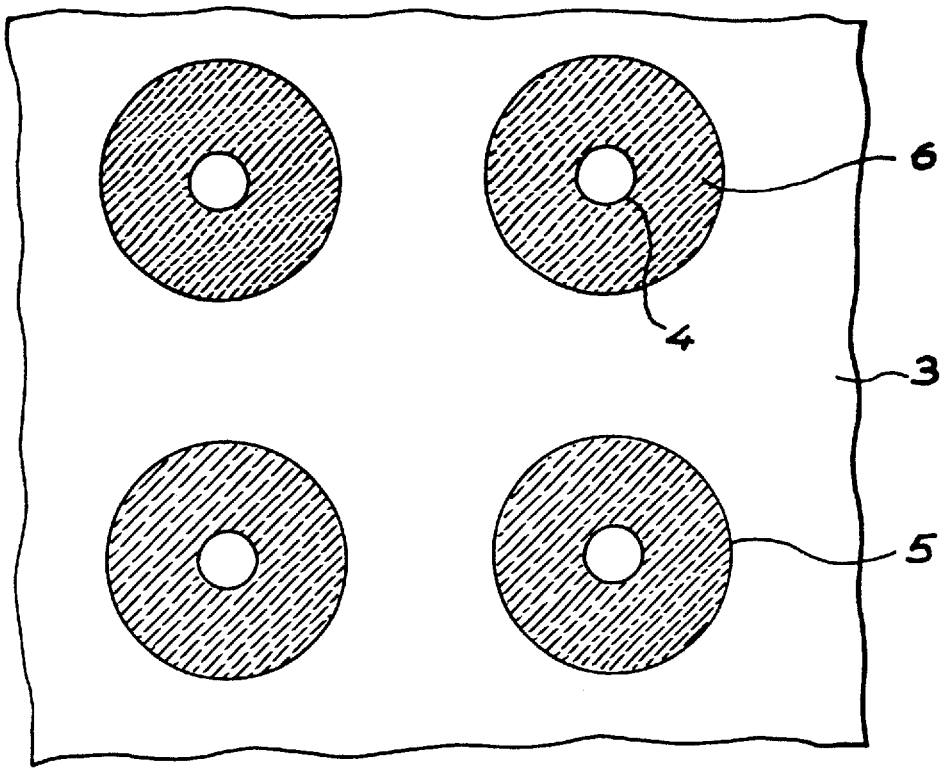
FIG. 3 represents, seen from above, a photolithography template used for the carrying out the process according to the present invention.

FIG. 3 represents, seen from above, a template 3 which can be used for carrying out the process according to the present invention. It includes four identical patterns formed by an interior circle 4 and an exterior circle 5, the circles 4 and 5 being concentric. The space 6 between the circles 4 and 5 is dark whereas the rest of the template is light.

Figure 4:
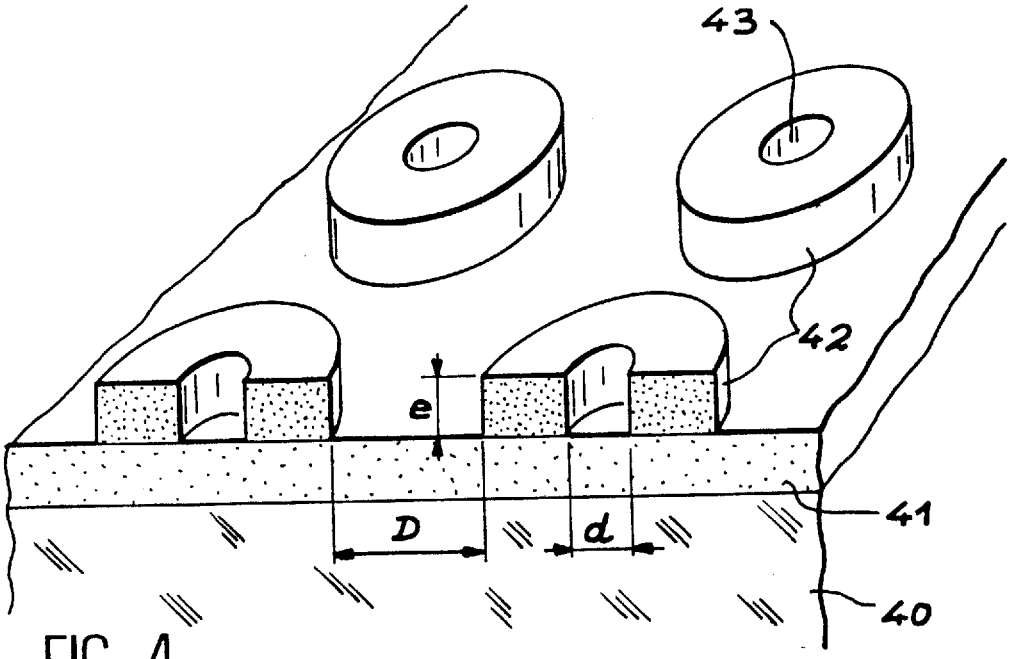
FIGS. 4 to 6 illustrate the process according to the present invention for which the template of FIG. 3 is used.

If a layer of positive resin is insolated, through the template 3, after development there will only be resin at the places corresponding to the dark parts of the template, i.e. at the places corresponding to the spaces 6. This is shown by FIG. 4 which is a perspective and cross-section view of a substrate 40, covered by a layer 41 of a first material, this layer 41, supporting spots 42 of resin whose shape corresponds to that of a space 6 on the template. The spots 42 have a thickness corresponding to a layer of resin deposited on the layer 41. If the diameter of the holes 43 which are central to the spots is d, the distance D separating two successive spots of resin will be chosen greater than 2d.

Figure 5:
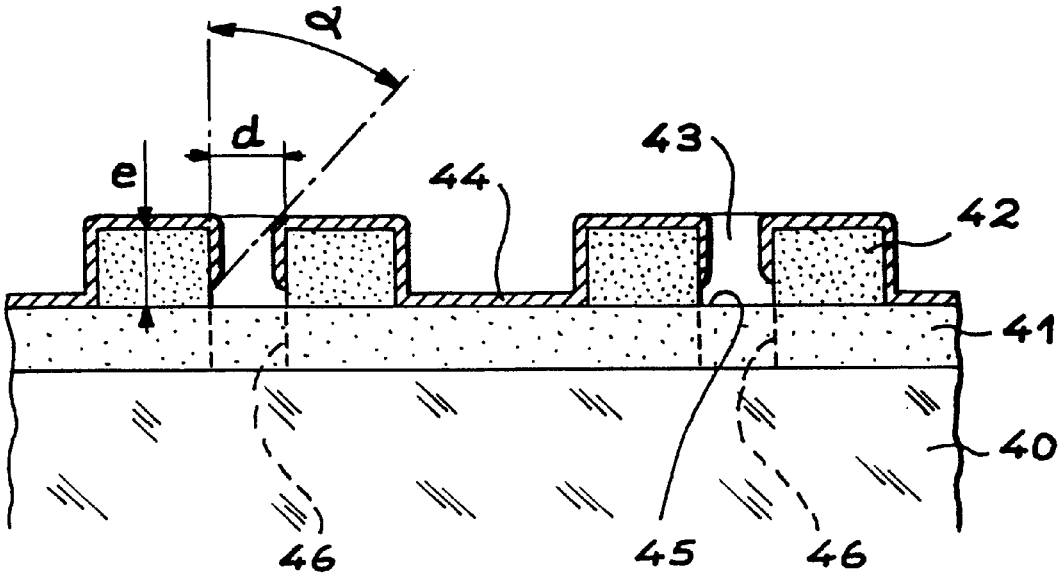

FIG. 5 is a cross-section view of the structure illustrated by FIG. 4 and on which a layer 44 of material has been deposited by vacuum evaporation, with an incidence greater than an angle · such that tg ·=d/e and by turning the structure around an axis perpendicular to its area. The bottoms 45 of the holes 43 are not covered by the layer 44. If the layer 41 covered by the resin spots 42 and the layer 44 are etched, only the bottoms 45 of the holes which are not protected will be etched in the prolongation of the holes 43. The apertures 46 are obtained as indicated by the unbroken lines.

Figure 6:
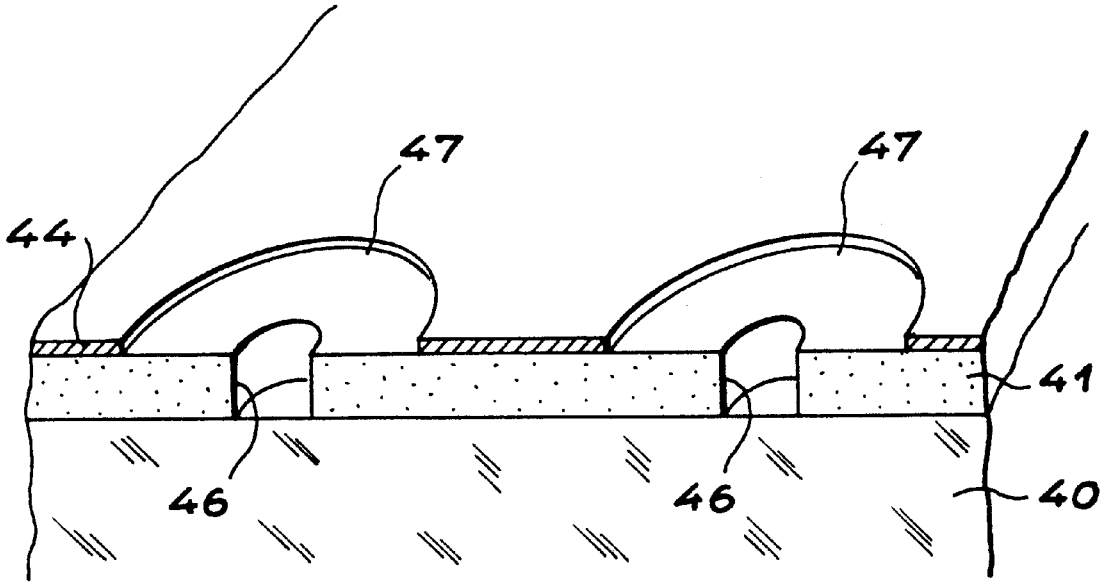

FIG. 6, which is a perspective and cross-section view, also shows the structure obtained after having eliminated the resin spots. Holes 46 in a layer 41 are thereby obtained which are perfectly centred with the holes 47 of greater diameter made in a layer 44 deposited on the layer 41.

The process for making a micropoint electron source for a flat viewing screen by the present invention will now be described. This micropoint electron source is designed to have a focussing grid of which the apertures are slits, each slit covering several apertures of the extraction grid. The process will be described in reference to FIGS. 7A to 7F which are cross-section views, FIG. 7F also being a perspective view.

On a support 50 composed of a glass chip, a metallic layer is deposited (see FIG. 7A) which is etched to make cathodic conductors 51 which are parallel to each other. These cathodic conductors 51 can be used as columns for matrix display for example. A resistant layer 52 is then deposited in a uniform manner. On this resistant layer 52 are successively deposited a first insulating layer 53, a conducting layer 54 to form the extraction grid for the micropoint electron source, and a second insulating layer 55. The thickness of the insulating layers 53 and 55 are chosen as a function of the chosen height of the micropoints and the distance which must separate the extraction grid from the focussing grid. A layer of photosensitive resin is then deposited in a uniform manner on the second insulating layer 55.

The photosensitive resin layer is insolated through a template of which the pattern includes in dark, if the photosensitive resin is a positive resin, the space separating the contour of each aperture of the focussing grid (in the form of a slit in the present case) from the contour of the apertures of the extraction grid corresponding to this grid aperture. With development, only the spots of resin 56 will remain on the insulating layer 55, each spot 56 being pierced by apertures 57 in the number corresponding to the number of micropoints seen by an aperture of the focussing grid.

Figure 7A:
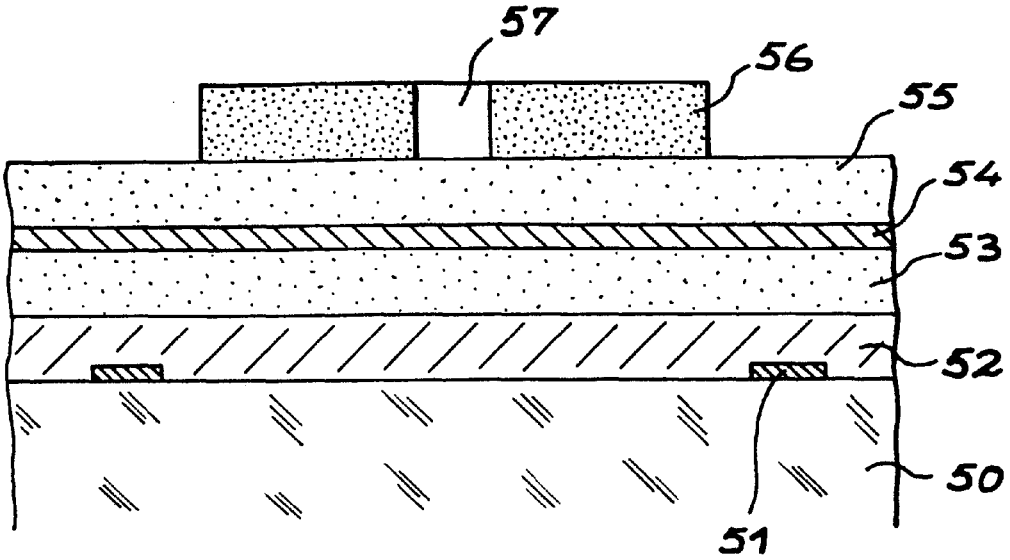
FIGS. 7A to 7F illustrate different steps in the manufacturing of a micropoint election source for a flat viewing screen, according to the process of the present invention.
Figure 7B:
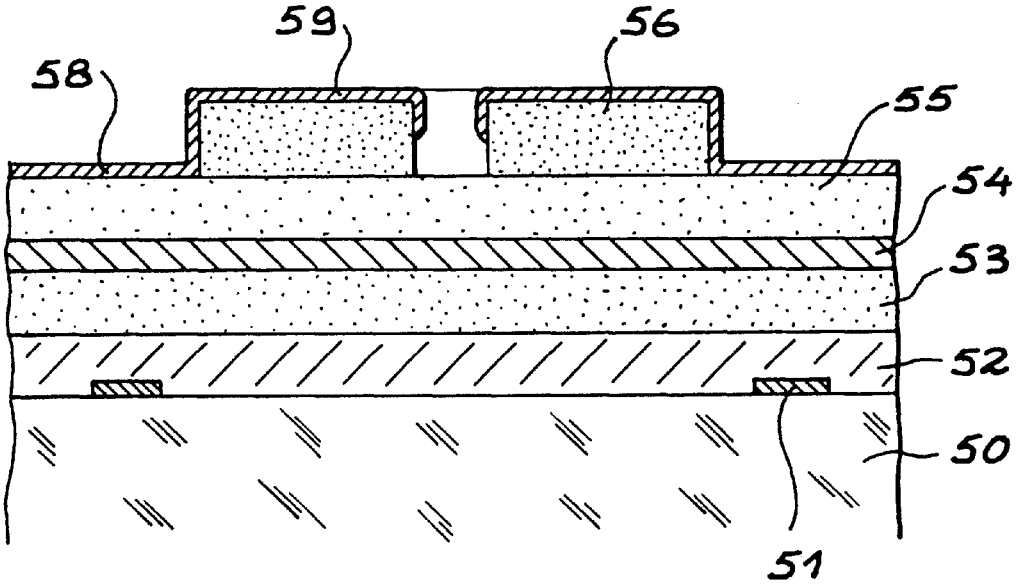
Figure 7C:
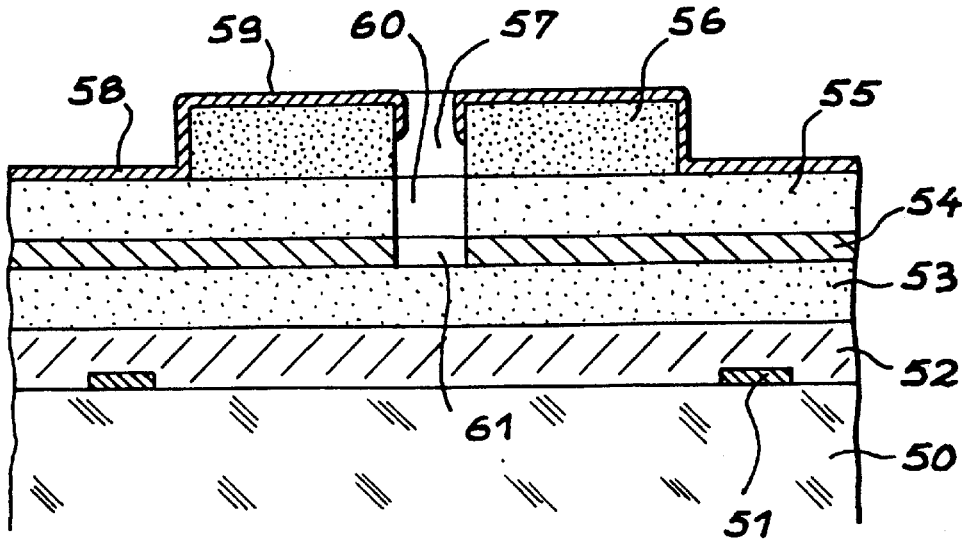
Figure 7D:
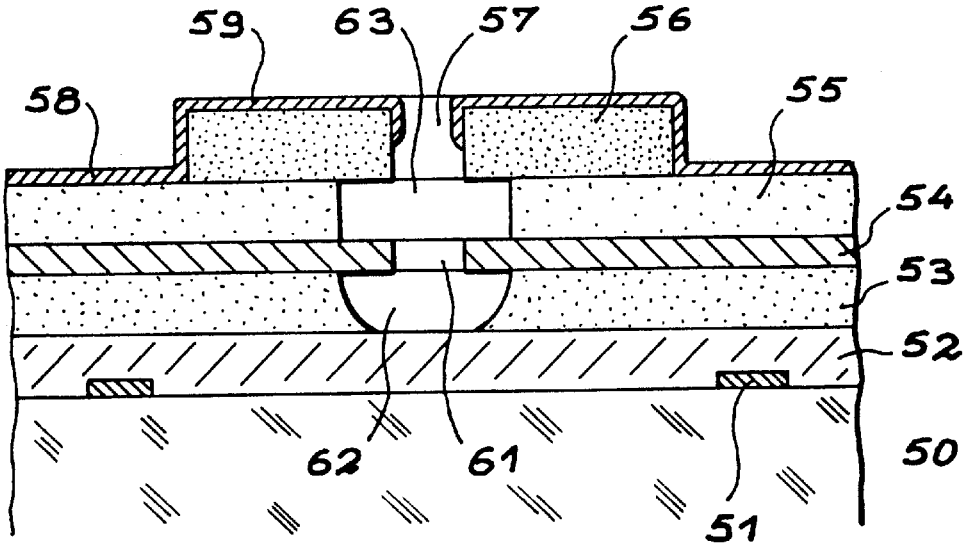

The conducting material from which the focussing grid will be formed is then applied by vacuum evaporation (see FIG. 7B). This evaporation is done with an angle of incidence such that conducting material is only deposited at the bottom of the apertures 57. A conducting layer 58 is thus obtained on the second insulating layer 55 and a conducting layer 59 on the resin spots 56 with the exception of the bottoms of the apertures 57. The conducting layer 58 forms the focussing grid. Next comes the anisotrope etching of the second insulating layer 55 from the bottom of the apertures 57 to obtain holes 60 in this layer, in prolongation of the apertures 57, until they reach the conducting layer 54 (see FIG. 7C). The conducting layer 54 is then etched to obtain apertures 61 (apertures of the extraction grid), as a prolongation of the apertures 57 and the holes 60, until they reach the first insulating layer 53.

The first insulating layer 53 is then etched from the apertures 57, holes 60 and apertures 61. One cavity 62 per aperture 61 of the extraction grid is obtained on anisotropic etching. This cavity 62 has as its base the resistant layer 52 which is not attacked (see FIG. 7D). By the same etching, the second insulating layer 55 can also be laterally attacked from the walls of the holes 60 (see FIG. 7C) to obtain enlarged holes 63. This is possible if the two insulating layers are made of the same material. The etching is done until intersecting holes 63 are obtained.

Figure 7E:
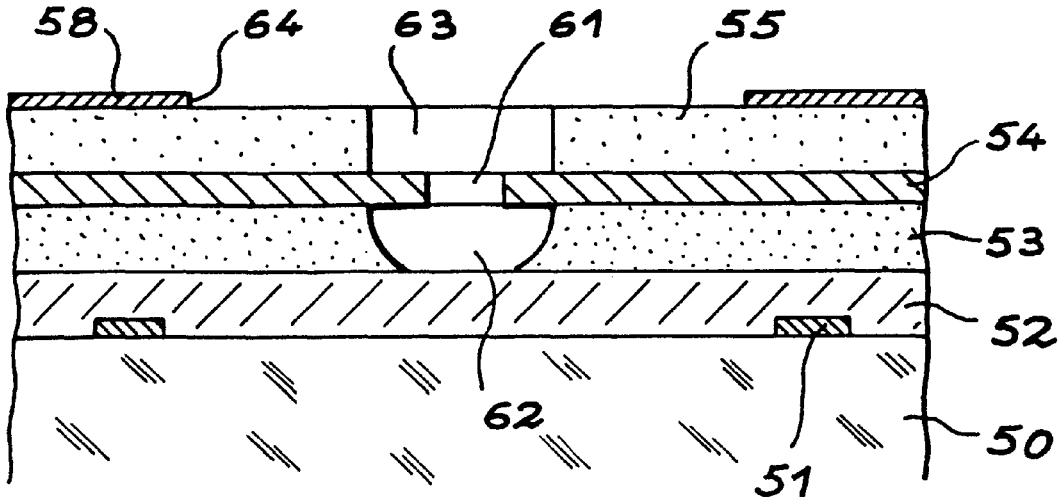

FIG. 7E shows the structure obtained after dissolution of the spots of resin and the conducting layer which covered them. The focussing grid 58 with apertures or slits 64 remains on the surface of the second insulating layer 55.

The micropoints are then applied through the apertures of the extraction grill in the usual manner.

Figure 7F:
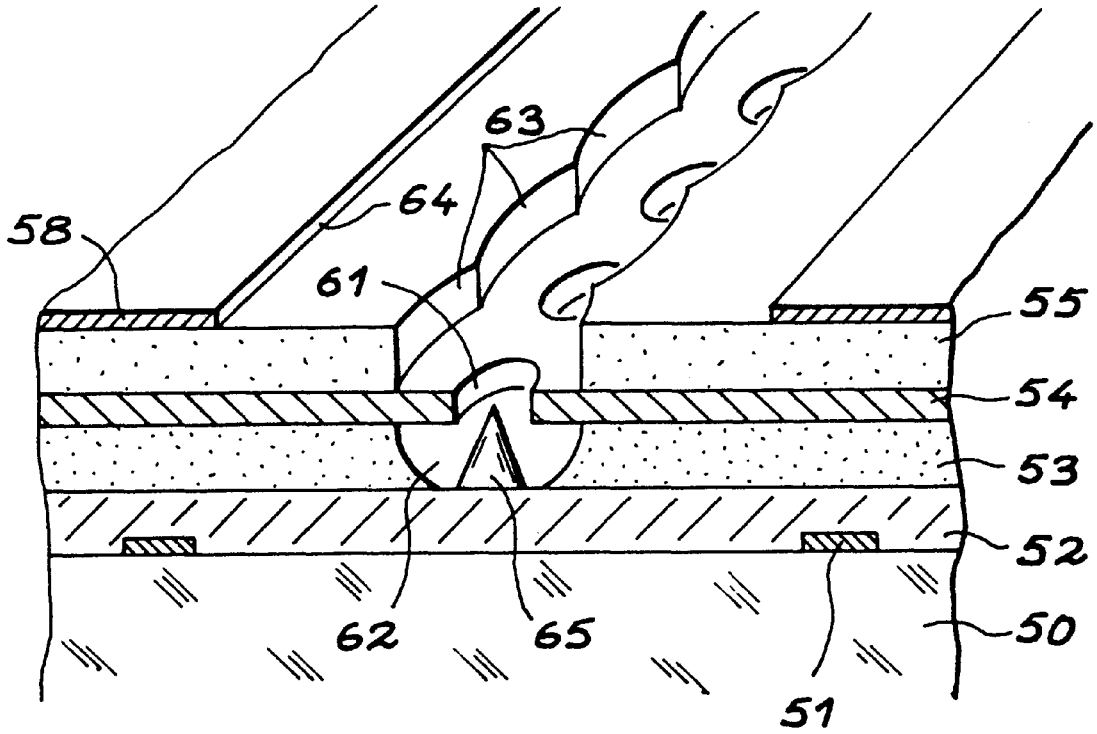

FIG. 7F shows several micropoints 65, each centred in its corresponding aperture 61 of the extraction grid, the axes of the apertures 61 for a given slit 64 being strictly aligned with the main axis of the slit.

What is claimed is:

1. Process for making by photolithoghraphy at least one group of apertures spaced in a precise manner on a structure, this group of apertures including a first aperture or apertures made in a first layer of material and a second aperture made in a second layer of material which covers the first layer of material, the first aperture or apertures being located within the second aperture, involving:

applying on a free side of the first layer of material a layer of photosensitive resin of a determined thickness, the etching of this resin layer by photolithography, by means of a single template, to leave on the aforesaid first layer of material a spot of resin per group of apertures, the exterior limit of the spot of resin corresponding to the second aperture, the spot of resin including an aperture or apertures corresponding to the first aperture or apertures, vacuum application, on the first layer and on the remaining resin, of material to form the second layer, this deposit being done so that the part of the first layer located at the bottom of the aperture or apertures of the spot of resin is not covered by this deposit, the etching of the first layer of material from the aperture or apertures of the spot to obtain the first aperture or apertures in the aforesaid first layer, elimination of the remaining resin and material from the second layer covering the aforesaid remaining resin to obtain the second aperture in the aforesaid second layer.

2. Process according to claim 1, wherein the aforesaid group of apertures includes a first aperture which is a circular hole centered in the second aperture which is also a circular hole.

3. Process according to claim 1, wherein the aforesaid group of apertures includes first apertures which are circular holes oriented on the main axis of the second aperture which is a slit.

4. Process for manufacturing a micropoint electron source with an extraction grid and focussing grid, including:

a step during which are successively applied to one side of an electrically-insulated support: means for cathodic connection, a first layer of electrical insulation of a thickness adapted to the height of the future micropoints, a first conducting layer to form the extraction grid, a second electrically insulating layer of thickness corresponding to the distance which must separate the extraction grid from the focussing grid, and a layer of photosensitive resin of a given thickness, a step for etching the resin layer by photolithography, by means of a single template, to leave on the aforesaid second insulating layer one spot of resin per aperture of the focussing grid, the exterior limit of the aforesaid spot of resin corresponding to the aforesaid aperture of the focussing grid, the spot of resin including one aperture per aperture of the extraction grid contained in the aforesaid aperture of the focussing grid, a step for vacuum application on the second insulating layer and on the remaining resin of a material to form the focussing grid, this deposit being made so that the part of the second insulating layer located at the bottom of each aperture of the spot of resin is not covered by this deposit, a step during which the second insulating layer and the first conducting layer are successively etched from the part of the second insulating layer not covered by the aforesaid deposit to obtain holes in the second insulating layer and the apertures of the extraction grid, a step for etching of the first insulating layer through the apertures of the extraction grid up to the means of cathodic connection, a step of lateral etching of the second insulating layer to increase the size of the holes etched previously to a given value, this lateral etching possibly intersecting adjacent holes which are sufficiently close, a step involving elimination of the remaining resin and the part of the material to make the focussing grid which covers the remaining resin, a step for making micropoints on the means of cathodic connection through the apertures in the extraction grid.

5. Process according to claim 4, wherein the means of cathodic connection are obtained by depositing cathodic conductors on the support, followed by depositing of a resistant layer.

6. Process according to claim 4, wherein the step for etching of the first insulating layer and the step for lateral etching of the second insulating layer are done simultaneously and by isotropic etching.

7. Process according to claim 4, wherein the elimination of the remaining resin is done by the lift-off technique.

* * * * *